US005801363A

United States Patent [19]

Michaluk, III

[11] Patent Number: 5,801,363

[45] Date of Patent: *Sep. 1, 1998

[54] MICROWAVE OVEN WITH BUILT-IN FOOD COVERING MECHANISM

[76] Inventor: Mitchell Michaluk, III, 17501 Mulvaney, Manchester, Mich. 48158

[*] Notice: The term of this patent shall not extend beyond the expiration date of Pat. No. 5,660,755.

[21] Appl. No.: 852,183

[22] Filed: May 6, 1997

Related U.S. Application Data

[63] Continuation-in-part of Ser. No. 599,678, Feb. 12, 1996, Pat. No. 5,660,755, which is a continuation-in-part of Ser. No. 262,922, Jun. 20, 1994, Pat. No. 5,550,356.

[51] Int. Cl.[6] ..... H05B 6/80

[52] U.S. Cl. ..... 219/734; 219/702; 219/756; 219/403; 99/DIG. 14; 126/220; 126/340

[58] Field of Search ..... 219/734, 729, 219/685, 736, 745, 756, 757, 752, 405, 403, 404, 762, 702, 704; 126/220, 340

[56] References Cited

U.S. PATENT DOCUMENTS

| | | | |
|---|---|---|---|
| 3,854,021 | 12/1974 | Moore et al. | 219/734 |
| 3,980,856 | 9/1976 | Allen et al. . | |
| 4,303,819 | 12/1981 | Kaufman, Jr. et al. | 219/762 |
| 4,488,025 | 12/1984 | Tanabe | 219/685 |
| 4,596,914 | 6/1986 | Morino | 219/685 |
| 4,629,850 | 12/1986 | Tanabe | 219/685 |
| 5,550,356 | 8/1996 | Tripp et al. | 219/734 |
| 5,660,755 | 8/1997 | Michaluk, III | 219/734 |

FOREIGN PATENT DOCUMENTS

| | | |
|---|---|---|
| 52-74941 | 6/1977 | Japan . |

*Primary Examiner*—Philip H. Leung
*Attorney, Agent, or Firm*—Gifford, Krass, Groh, Sprinkle, Patmore, Anderson & Citkowski,P.C.

[57] ABSTRACT

A microwave oven with built-in food covering mechanism, the microwave having a body defined by a top, bottom, sides and rear. A door is hingedly connected to the body and is opened to reveal an open interior of the body. A covering member is suspended within the oven interior and is operably connected to an electric motor built into the microwave body. The motor includes a rotating gear head which rotates in one of two directions to either wind or unwind the cord to either elevate or lower the covering member within the interior. A microprocessor energizes and deenergizes the motor and is operated by any of a selection of spring loaded, pressure actuated or sensing switch assemblies within the microwave interior.

11 Claims, 6 Drawing Sheets

Fig-13
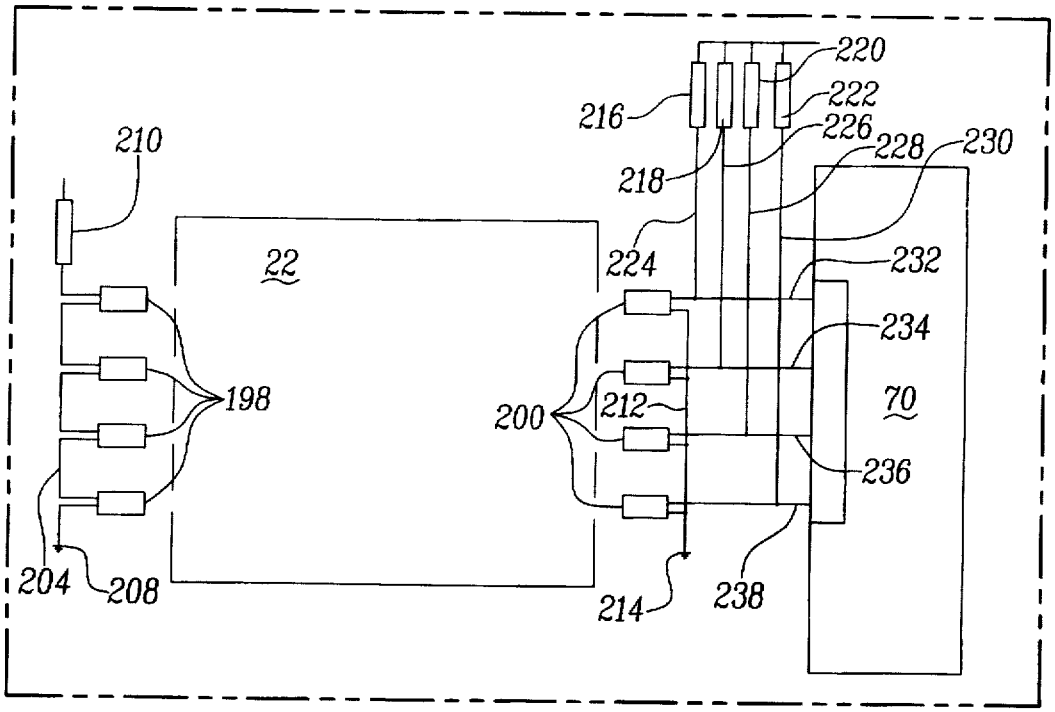
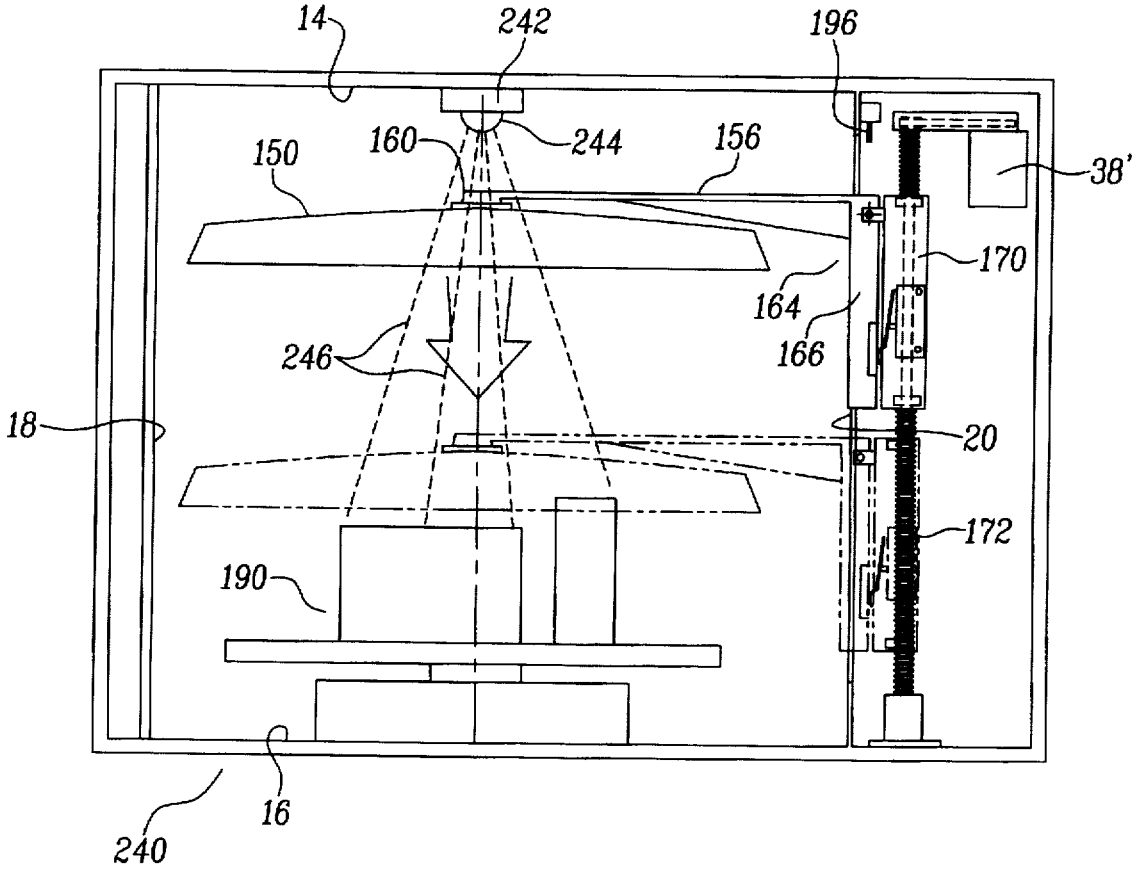
Fig-14

MICROWAVE OVEN WITH BUILT-IN FOOD COVERING MECHANISM

CROSS REFERENCE TO RELATED APPLICATIONS

The present application is a continuation-in-part of U.S. Ser. No. 08/599,678, filed Feb. 12, 1996, U.S. Pat. No. 5,660,755 for a Microwave Oven with Built-in Food Covering Mechanism which is in turn a continuation-in-part of U.S. Ser. No. 08/262,922 filed Jun. 20, 1994, U.S. Pat. No. 5,550,356, for A Food Covering Device For Use With a Microwave Oven.

BACKGROUND OF THE INVENTION

1. Field of the Invention

The present invention relates generally to food covering devices and, more specifically, to a microwave oven with a built-in food covering mechanism which is upwardly and downwardly movable in either an automatic or a manually controlled fashion for selectively covering or uncovering an item placed within the microwave interior.

2. Description of the Prior Art

Covering devices of various types and designs are known in the art for covering a food item placed within a microwave during the heating stage. Such covering devices are advantageously used within the microwave oven for preventing the food item being heated from splattering the inside of the oven surfaces during the microwaving process.

Application U.S. Ser. No. 08/599,678, now U.S. Pat. No. 5,660,755 discloses a microwave oven with a built-in food covering mechanism. The oven includes a body with an open interior defined by a top, bottom and sides. A door is hingedly attached to the microwave body and is capable of being opened and closed to reveal the open interior. A covering member is suspended by a length of cord from a top of the oven interior and actuating means are provided in the form of a winding and unwinding rotating gear head portion which engages the cord and which is operable by an electric motor for elevating and lowering the covering member. A microprocessor with program memory means is provided in operative communication with a key entry display and the actuating motor for either selectively or automatically raising and lowering the covering member.

Application U.S. Ser. No. 08/262,922, U.S. Pat. No. 5,550,356, further teaches a food covering device for use with a microwave in which a food covering member is suspended from a ceiling of the microwave interior by a cord. The cord attaches to the covering member at one end and to a door of the microwave at the other end. An adjustment guide is mounted to a wall of the oven and receives an intermediate portion of the cord in order to adjust the extent of the raising and lowering of the covering member in a purely manual operable fashion upon the opening and closing of the door.

Japanese Reference No. 52-7491 teaches a high frequency heating device incorporated into a microwave oven which includes a lid member pivotable in an angular fashion about an edge by an arm, the arm having an intermediate joint and connecting to a door to separate the lid member from the food when the door is opened. A heater is fitted within the lid member to create scorch patterns in the food.

U.S. Pat. No. 3,854,021, issued to Moore et al., teaches a conductive shield device which is mounted within an electromagnetic heating system and which is similarly pivotable in an angular fashion about an edge. The device is specifically designed for use in a high-volume institutional setting such as a cafeteria to shield cold portions of a meal tray during microwaving. The shield is actuated between a covered and an upwardly tilted position by a lever and spring arrangement extending from the oven door to cover the cold portions of the meal prior to actuating the microwave device.

SUMMARY OF THE PRESENT INVENTION

The present invention is a microwave oven with a built-in food covering mechanism. The oven has a body with an open interior which is defined by a top, a bottom and a plurality of sides. A door is hingedly attached to the microwave body is capable of being opened and closed to reveal the open interior.

In a first preferred embodiment, the covering member is suspended by a length of cord from the top of the microwave interior. Positioned interiorly of the microwave enclosure and in proximity to the top is a spool assembly which includes a spool with an exteriorly facing and electrically communicating winding surface and a plurality of spring loaded wires which are arranged in parallel extending fashion at spaced apart distances and around a circumference of the spool portion. The weight of the covering member in its suspended position is transferred through the cord and causes one or more of the spring loaded wires to deflect inwardly and to contact the electrically communicating winding surface to thereby form a closed circuit.

An opposing end of the cord is wrapped around a rotating gear head portion of an electric motor built into the microwave body. The actuating means further includes a microprocessor which is in communication with the electric motor and, in response to a closed circuit in the spool, activates the motor to lower the cover. The suspending weight of the covering member is reduced or eliminated entirely upon the member contacting a food item place atop the bottom of the oven interior, with the resultant slackening of the cord causing the spring loaded wires to deflect outwardly away from the electrically communicating spool surface and an open circuit being created which instructs the microprocessor to shut off the electric motor. A limit switch is likewise located at the top of the microwave interior and, upon being abuttingly contacted by an upwardly retracting covering member, instructs the microprocessor to shut off the electric motor.

A key entry display is provided on a front face of the microwave and communicates with the microprocessor to visually display settings which correspond to the commands issued by the microprocessor and to also issue commands to the microprocessor. A program memory is also in communication with the microprocessor and is capable of storing to memory key entered cover settings. The covering member may also be elevated and lowered using preset operating parameters which are loaded into the program memory.

According to a further preferred embodiment, the cover member is suspended from a laterally projecting arm which extends in a substantially horizontal manner through a vertically formed channel in a selected side wall of the microwave interior and which is mounted by an appropriate sleeve portion to a vertically arranged rotatable and threaded shaft. The shaft is similarly operable by an electric motor and, upon being rotated in a selected rotational direction, both elevates and lowers the covering member within the microwave interior.

In one operable variant of the further preferred embodiment, a pressure actuated lever and switch assembly may be incorporated into the connection between the laterally projecting arm and the interconnecting sleeve portion. Similarly to the spool and spring loaded wire construction of the first preferred embodiment, the lever and switch assembly is operable in response to a reduction or total elimination of the suspending weight of the covering member, which is again indicative of the covering member coming into abutting and resting contact with a food item, to pivot to an open circuit and to cause the microprocessor to instruct the motor to deactivate the rotatable shaft.

In a further operable variant of the present invention, the operation of the covering member via the vertically disposed shaft is controlled by a plurality of matched pairs of vertically spaced apart and horizontally directed light emitting diodes and photo transistors. A selected number of photo diodes are arranged at vertically spaced apart increments along a first selected side of the microwave interior and are each operable to transmit a light beam according to a given intensity and angular width and in a substantially horizontal fashion across the interior of the microwave enclosure.

A like number of photo transistors are located along an opposing side of the microwave interior at similar spaced apart increments and are each in operative communication with an individual pull up resistor and the system microprocessor. The illumination of a selected photo transistor by its associated diode is indicative of an unobstructed path between the diode and transistor and the absence of any object. The failure of a selected diode to illuminate its associated transistor, specifically from the lowest situated diode on up, is indicative of a determined height of a food item which is placed within the microwave interior. Any number of paired photo diodes and transistors can be utilized and, by using a greater number of pairs, enables the microprocessor to determine to a greater degree of accuracy a height of the food item which in turn dictates to what extent the covering member is to be lowered.

In a yet further operable variant which utilizes the laterally projecting arm for suspending the covering member as well as the threaded and rotatable shaft, a radar emitter/receptor is mounted in a generally centralized location to a top surface of the microwave oven interior. The radar emitter/receptor is capable of issuing radiation waves, such as X-rays, in pulse fashion and in an outwardly spread apart manner. The wavelength of the issued rays is such that they are capable of passing through the suspended covering member in both emitting and receiving directions and are further capable of being recollected by the emitter/receiver to assemble for the microprocessor a three dimensional configuration of a food item which is placed upon the bottom of the oven interior. The microprocessor may then in turn instruct the appropriate lowering of the covering member by engaging the electric motor to operate the rotatable shaft.

BRIEF DESCRIPTION OF THE DRAWINGS

Reference will now be had to the attached drawings, when read in combination with the following specification, wherein like reference numerals refer to like parts throughout the several views, and in which:

FIG. 13 is a schematic illustration of the pairs of diodes and transistors which are best illustrated in FIG. 12 and explaining how they operate to activate the microprocessor; and FIG. 14 is a frontal view in cutaway of a still further variant of the further preferred embodiment of the present invention and illustrating the radar emitter and receptor for assembling a three dimensional image of a food item placed upon the oven interior.

DESCRIPTION OF THE PREFERRED EMBODIMENTS

Figure 1:
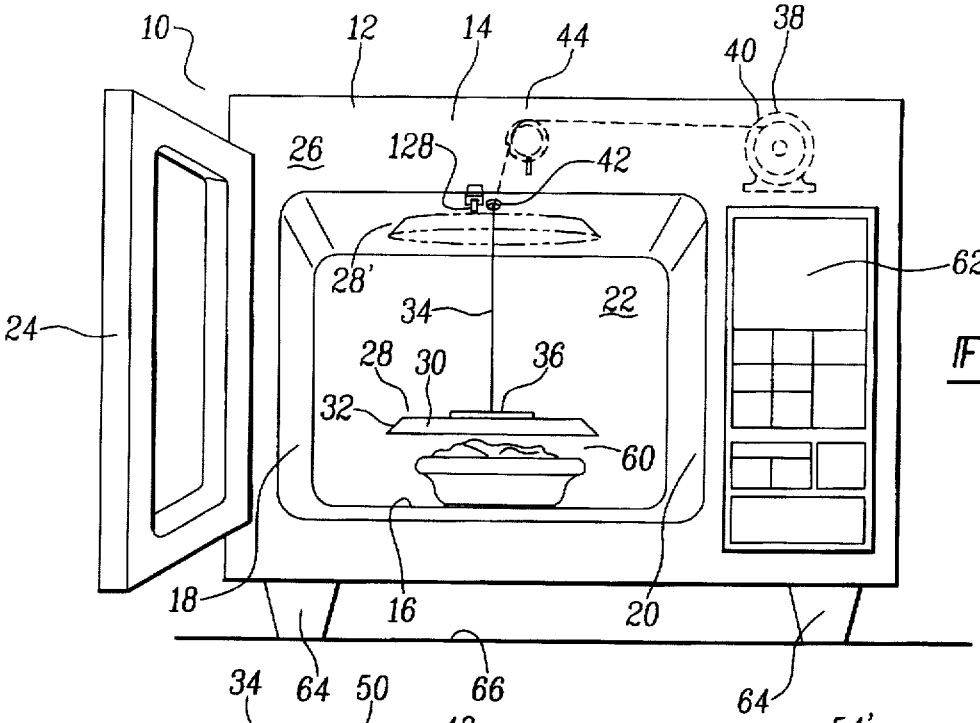
FIG. 1 is a view of the microwave oven with built-in food covering mechanism according to a first preferred embodiment of the present invention.

Referring to FIG. 1, a microwave oven with built-in food covering mechanism 10 is shown according to a first preferred embodiment of the present invention. A microwave oven has a body 12 which is of a type and design consistent with conventional models and is constructed of a top 14, a bottom 16, a first side 18, a second side 20 and a rear side 22 which in combination defines an open interior. A door 24 is hingedly attached to a front face 26 of the body 12 in proximity to the first side 18 and is pivotable about the connection to selectively open and close the door to reveal the open interior. The open interior is consistent with that of most conventional microwave ovens and is defined by a substantially rectangular or square shape. However, the interior may adopt any other desired shape.

A cover member 28 is positioned within the microwave open interior and, according to a preferred embodiment, includes a generally planar body portion 30 which is rimmed by an angled side portion 32. The cover member 28 is preferably circular in cross section with the side portion 32 ringing the circumference of the body portion 30, however the cover member can form any desired shape which is capable of being fit within the open interior. A suspending means selectively elevates and lowers the cover member 30. The suspending means is preferably provided by a length of cord 34, a first end of which attached to a top central portion of the cover member 28, at 36, and a second end of which is attached to an electric gear motor 38, at 40. The cord 34 extends through an opening 42 positioned centrally within the oven top 14 and the electric motor 38 is mounted within the microwave body 12 at a position away from the open interior.

Figure 2:
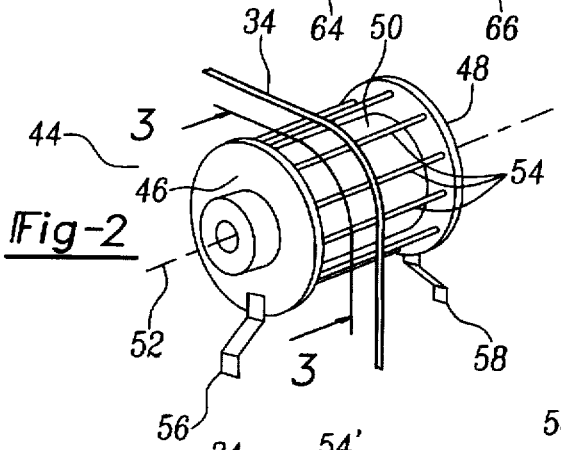
FIG. 2 is a partial view of a winding spool with circumferentially arrayed spring loaded wires for receiving the winding cord in a first slackened and undeflected position in which an open circuit is formed with a microprocessor and electric motor of the present invention.

Referring again to FIG. 1, and also to FIG. 2, a sensing spool assembly 44 is illustrated and which may be either fixedly or rotatably mounted above the opening 42 between the cover member 28 and the motor 38 for supporting the cord 34. The spool assembly 44 is capable of receiving the cord 34 in order to support the weight of the covering member and is constructed of a substantially cylindrical shaped winding spool body having a disk shaped first end 46, a disk shaped second end 48 and a cylindrical exteriorly facing and electrically communicable winding surface 50 extending therebetween. The spool assembly 44 is either fixedly or rotatably mounted within the body of the oven 12 and, if rotatably mounted, is capable of revolving about an appropriate axle portion (not illustrated) so that it is capable of rotating about an axis 52 (see FIG. 2).

A plurality of spring loaded wires 54 are drawn across the spool assembly 44 and are secured to outer edges of opposing and inwardly facing surfaces of the first and second disk shaped ends 46 and 48 so that they extend in a spaced apart and circumferential fashion relative to the exterior winding surface 50. The spring loaded wires 54 are also electrically communicable and, as will be subsequently described, are capable of being deflected inwardly by the suspended weight of the covering member 28 through the cord 34 so that a portion of one or more of the selected wires 54 contacts the exteriorly facing and likewise electrically communicable winding surface 50. A pair of sliding contacts 56 and 58 extend from the disk shaped ends 46 and 48 of the winding spool body, respectively, and are maintained in constant electrical contact with the electric motor 38 via a system microprocessor (as will be subsequently described) through an electrically communicable connection extending therebetween (not shown) whether or not the spool assembly is fixedly or rotatably secured.

A tension spring switch assembly is created by the selective engagement and disengagement of the spring loaded wires 54 with the likewise electrically communicable surface 50 of the spool assembly to activate and deactivate the downward actuation of the covering member according to the first preferred embodiment will now be made. As will be subsequently described and as is best shown in the cutaway views of FIG. 3 and the exaggerated view of FIG. 4, a closed circuit is formed with the electric motor 38 to cause the covering member to downwardly actuate when at least one or more of the individual spring-loaded wires 54 (see wire 54' in FIG. 3) becomes inwardly deflected against the exterior surface 50 of the spool assembly body due to the suspending weight of the covering member 28 being transferred through the cord 34 which is in turn drawn across the plurality of spring loaded wires 54.

Figure 4:
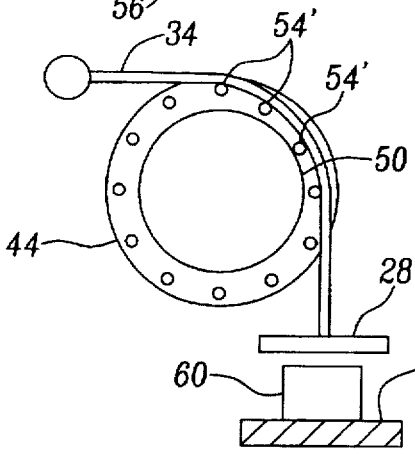
FIG. 4 is a side view in cutaway and in exaggerated illustration of the inwardly deflected position of the spring loaded wires against the winding spool as illustrated in the cutaway view of FIG. 3.
Figure 5:
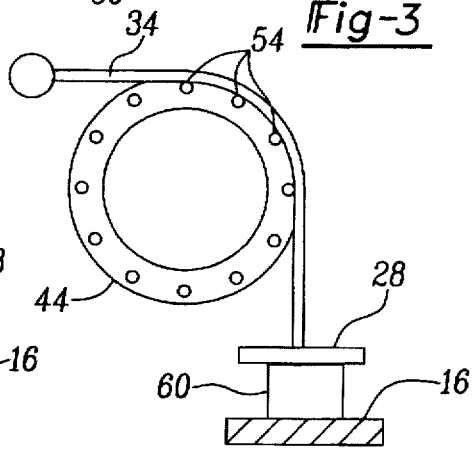
FIG. 5 is a likewise side view in cutaway and in exaggerated illustration of the undeflected position of the spring loaded wires relative to the winding spool as illustrated in the view of FIG. 2.

The covering member 28 (which is illustrated in only representative fashion in FIGS. 4 and 5) will continue to be lowered until it contacts a food item 60 (illustrated in approximate fashion in FIG. 1 and in representative fashion in FIGS. 4 and 5). Upon the covering member 28 combing into abutting contact with the food item 60, a partial or complete slackening in the cord 34 is sensed which is a result of part or all of the suspending weight of the covering member being assumed by the food item 60 or container within which the food item may be stored. The slackening in the cord 34 results in the compression of the spring loaded wires 54 by the cord 34 being relaxed and the wires 54 responsively outwardly deflecting away from the exterior surface 50 of the spool assembly to thereby open the circuit with the motor. Upon the creation of an open circuit, the motor 38 terminates the downward actuation of the covering member 28 and may also perhaps be programmed to retract the cover member 28 a predetermined reversed and upward direction in order to unseat it from contact with the food item and to position it in an optimum position relative to the food item to be heated.

Referring once again to FIG. 1, a key entry means 62 is provided on the front face 26 of the oven 12 on the side of the open interior and is in electrical communication with the motor 38 for actuating the cover member 28 from a position 28' indicated in phantom in which the cover 28 is positioned proximate the top 14 of the interior enclosure to a lowered position in which the cover 28 is positioned overhead the food item 60 which is set upon the bottom 16. Finally, a plurality of set-offs 64 support the microwave body 12 in an upwardly spaced manner upon a flat surface 56.

Referring now to FIG. 2, a control diagram 68 is shown which illustrates the actuation means for elevating and lowering the covering member 28 in either an automatic or controlled fashion and which is further applicable to the first preferred embodiment as well as any of the further preferred embodiments of the present invention. The key entry 62 identified in FIG. 1 is in electrical communication with a microprocessor 70 which is also built into the circuitry of the microwave body 12. Also in communication with the microprocessor 70 and working in combination with the key entry means 62 is a program memory 72. The program memory 72 is capable of storing operating parameters inputted into the key entry means 62 for retrieval by the microprocessor as will now be discussed.

The key entry means 62 according to the preferred embodiment is primarily separated into three major portions, a visual display portion 74, a conventional microwave keyboard entry portion 76 and a cover member program memory portion 78. The key entry means 62 may also include such conventional microwave features as a cook button 80 and an open door button 82. A separate on/off cover command button 84 is also provided on the key entry 62 for directly activating and deactivating the cover member 28.

Referring again to FIG. 2, a user of the microwave can key enter typical command functions relating to heat time and defrost cycles by utilizing the command buttons in the entry portion 76. The commands entered into the key portion 76 are electrically issued to the microprocessor 70 through a line 86 extending between the key portion 76 and the microprocessor 70. The commands entered through the key portion 76 are processed by the microprocessor 70 which then issues the appropriate commands to a magnetron 88 through a line 90 extending therebetween. The magnetron 88 generates the microwaves for heating the food item placed within the open interior as is shown in FIG. 1 and is of a conventional type and design. A line 92 connects the microprocessor 70 to the visual display portion 74 of the key entry 62 and displays such visual data as remaining heating time, defrost or regular cook cycle, and the like.

The microprocessor 70 commands discussed above are those typically associated with a conventionally operating microwave oven without a cover mechanism according to the present invention. Referring again to FIG. 2, the program memory portion 78 of the key entry 62 provides a user with the ability to program one or more lower and lift cycles of the cover member 28 or to directly actuate the cover member upwards and downwards. A set button 94 is depressed to enable the user to enter either a first program setting 96, a second program setting 98, or a third program setting 100. An upward directional button 102 and a downward directional button 104 are separately actuable to either manually raise or lower the cover member 28 or are utilized in combination with the set button 94 and program setting buttons 96, 98 and 100 to establish a desired program setting. An operating sequence for programming a cover setting can be provided by first depressing the set button 94, sequentially depressing the upward directional button 102 and the downward directional button 104 to achieve a desired range of movement, and then depressing one of the first 96, second 98, or third 100 setting buttons to store the commands. A display portion 106 may be located in the program memory portion 78 for displaying the position of the cover member 28 according to the program setting buttons to assist the user in determining the best settings. The display of the cover member 28 may also be incorporated into the conventional display portion 74 to save on space in the key entry means 62 and the face of the key entry 62 can be reconfigured as desired to accommodate such a change.

A desired cover member program setting is inputted into the microprocessor 70 through a line 108 extending from the key entry 62 therebetween and the microprocessor proceeds to store the setting in the program memory 72 by inputting the appropriate signal through a line 110 which extends between the microprocessor 70 and program memory 72. Upon the appropriate memory command being entered into the key entry 62, such as by depressing one of the setting buttons 96, 98 or 100, the desired program command is signaled to the microprocessor 70 through line 108. The microprocessor 70 then queries the program memory 72 on line 110 and the program memory responds by issuing the appropriate command cycle to the microprocessor through a line 112 which extends therebetween and in parallel to the line 110. Alternatively, the microprocessor 70 is directly caused to issue the appropriate commands to the electric motor 38 to selectively elevate and lower the cover member 28 by simply depressing either the upward directional button 102 or the downward directional button 104.

The microprocessor 70 causes the electric motor 38 to activate and raise the cover member 28 in a first upward direction through a first activation signal issued on line 114. The cover member 28 is reversibly lowered in a second downward direction through a second activation signal issued by the microprocessor 70 on line 116. The motor 38 is of a conventional AC or DC type and preferably includes a rotating gear head member 118 upon which is wound a length of the cord 34 corresponding to the second end 38. The signals issued by microprocessor 70 cause the motor 38 to wind or unwind a desired length of the cord 34 to operate for a given time frame the motor to rotate the gear head 118, by causing the gear head to rotate in either a clockwise or counterclockwise direction in order to elevate or lower the cover member 28 the desired distance. The steps of lowering and elevating the cover member 28 are, according to a preferred embodiment, preset into the microprocessor 70 to correspond with the heating cycle of the oven such that the depressing of the cook 80 button on the key entry 62 causes the motor 38 to lower the cover member 28 to the lowered position shown in FIG. 1 and the termination of the heat or defrost cycle conversely causes the motor 38 to retract the cover member upwardly to the elevated position 28' also shown in FIG. 1.

According to a further preferred embodiment, the command to raise the cover member 28 may also be provided by depressing the button or lever 82 on the key entry 62 which causes a command to be issued to the microprocessor 70 via a line 120 connecting the microprocessor 70 to the open door button 82 concurrently with opening the microwave door 24. The cover 28 is again lowered by depressing the cook button 80 as previously described.

Referring again to FIG. 2, the spool assembly 44 is again illustrated in the first preferred embodiment for creating a spring tension switching arrangement for controlling an automatic and downward actuation of the covering member 28 and without the need for any of the functions of the previously described key entry 62 or program memory 72. The pair of sliding contacts 56 and 58 are in communication with the microprocessor 70 via communication line 122. A door switch 124 is incorporated into the microwave door latch mechanism and serves as the primary mechanism for actuating the elevating and lowering of the covering member 28. Upon closing the door 24, the switch 124 signals the microprocessor 70 through a communication line 126 to cause the microprocessor 70 to issue a signal on line 102 to in turn cause the gear head to rotate to unwind the cord 34 and attached cover 28. The downward motion of the cover 28 may also be triggered by depressing the cook button 80.

The cover member 28 accordingly descends downwardly within the microwave interior until contacting the food item or the bottom of the microwave. At that point, continued unwinding of the cord 34 causes a slackened tension between the cord 34 and the spring tensioned wires 54 against the exteriorly facing spool surface 50 as taught by the first of the preferred embodiments. Upon a sufficient slackening in the compression of the cord 34 against the spool surface 50 of the spool assembly, the selected spring loaded wires 54 which were previously in electrical contact with the surface 50 of the spool are deflected outwardly and thereby open the circuit between the sliding contacts 56 and 58 and the microprocessor 70. The signal along line 122 will thereby be interrupted by the open circuit which has thus been created and the microprocessor 70 will accordingly instruct the gear motor 38 by signaling along line 116 to shut off the downward actuation of the covering member 28.

Once the desired microwave function is completed, the motor 38 can be commanded to wind the cord 34 and elevate the cover member 28 by either opening the door 24 so as to trip the door switch 124 or by depressing the upward button 102 on the key entry 62. The cover 28 will then be elevated upwardly until it trips a limit switch 128 attached to the top surface 14 of the microwave interior. The upward movement of the cover member 28 causes it to depress the switch 128, which is also illustrated in FIG. 1, and the switch 128 then issues a disconnect signal to the microprocessor 70 along a line 130 which extends therebetween and which then causes the microprocessor 70 to issue terminate signal to the winding motor 38 along line 114.

Figure 7:
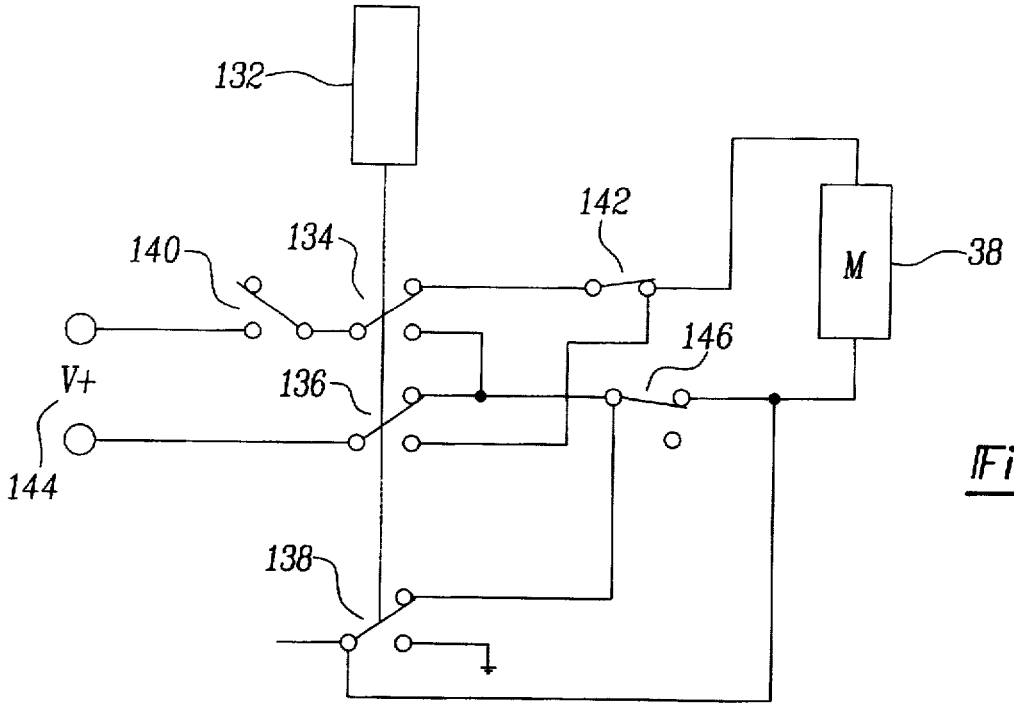
FIG. 7 is a schematic of the switch positions of the microwave oven and covering device according to a preferred embodiment at the beginning of a heating cycle.
Figure 8:
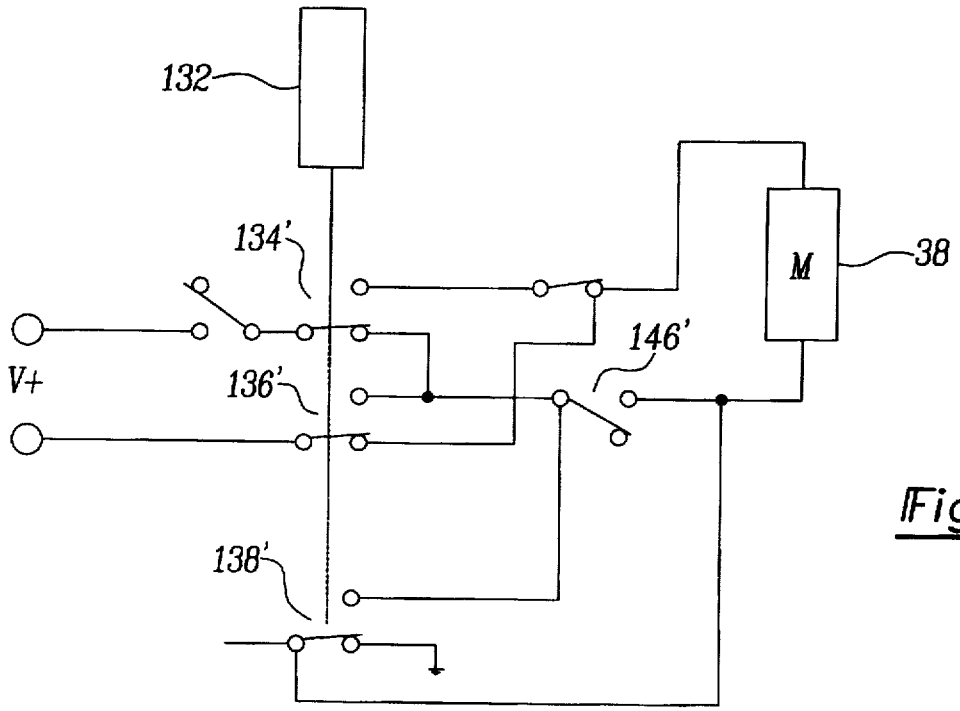
FIG. 8 is a schematic similar to that shown in FIG. 7 of the switch positions according to the preferred embodiment at the end of the heating cycle.

Referring now to FIGS. 7 and 8, the switch positions for elevating and lowering the microwave cover 28 are shown both prior to and at the end of the heating cycle. Referring to FIG. 7, a relay 132 is energized by the microwave control panel during the heating stage and causes a first relay contact 134, a second relay contact 136, and a third relay contact 138 all to be energized to first positions as illustrated. The first relay contact 134 according to FIG. 3 communicates a front panel enable/disable switch 140 with the spool assembly 48 with tension spring switch, identified as relay 142. The switch 142 is thus enabled/disabled to operate the downward motion of the cover 28 and to reset it to the proper position above the microwave bottom 16. The relay 136 connects the voltage supply, illustrated at 144, with the electric motor 38 to effect lowering of the cover 28 and the relay 138 closes a circuit with a relay 146 which represents the top of oven limit switch 128. The relay 146 enables the switch 128 in contemplation of rewinding of the cover member 28.

Figure 3:
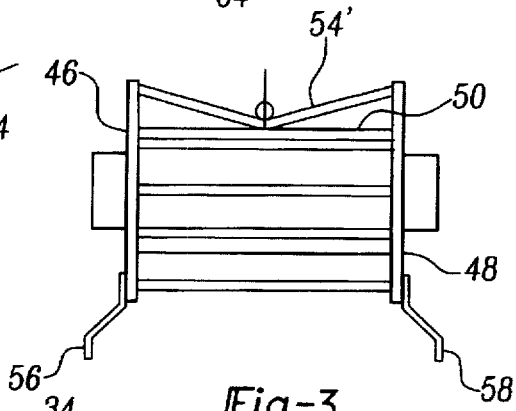
FIG. 3 is a cutaway view taken along line 3—3 of FIG. 2 and illustrating the winding spool and selected spring loaded wire in a second inwardly deflected and engaged position in which a closed circuit is formed with the microprocessor and electric motor of the present invention.

The relay and switch contacts shown in FIG. 3 remain in their described positions until the heating cycle ends or the microwave door is opened. Referring then to FIG. 4, the positions of the relays and switches upon completion of the heating cycle are reversed. The relay 132 is deenergized at the end of the cycle and in turn causes relays 134, 136 and 138 to reverse to positions 134', 136' and 138'. As a result, the relay contacts effectively reverse power to the motor 38 causing it to rotate in a reverse direction to lift the cover 28 upwardly. The top of oven switch is shown in a reversed position 146' upon being tripped by the upwardly elevating cover member 28 and having signaled the microprocessor 70 to disconnect the motor 38.

As is readily apparent from the above disclosure, the elevating and lowering features provided by the sensing spool assembly 48, the door switch 124, and the deactivation switch 128 can be incorporated along with the features shown in the key entry 62 and program memory 72 into the microwave device in order to prevent the program entry means from lowering the cover member 28 beyond what is required and the limit switch 128 from likewise elevating the cover member beyond its uppermost position.

Referring now to FIGS. 9–12, a series of views are illustrated at 148 of a microwave oven with built-in food covering mechanism according to a further preferred embodiment of the present invention. While the views of FIGS. 9–12 do not repeat in entirety all of the structural features of the oven 12 as shown in FIG. 1, it is understood that a similar oven type structure would be employed.

A covering member 150 is provided which is constructed similarly to the covering member 28 described in the first preferred embodiment 10 and likewise includes a substantially planar shaped body 152 with a side portion 154 ringing the circumference of the body portion 152. A laterally projecting arm 156 extends through a vertically extending channel 158 which in turn extends along the second side 20 of the microwave interior from an upper location proximate its top 14 to a likewise lower location proximate to its bottom 16. An inwardly projecting and free end 160 of the laterally projecting arm 156 secures in a substantially fixed manner to a centralized location of the covering member 150 in order to suspend within the interior of the oven 12.

The laterally projecting arm 156 is substantially elongated in shape and may be reinforced against excessive cantilever deflection by a webbed flange portion 162. The projecting arm 156 terminates at a position inwardly of the vertically extending channel 158 in a pivot switch assembly 164. The switch assembly 164 includes a first vertically extending member 166 which is pivotally connected at an upper location 168 to a sleeve 170. The sleeve 170 is includes a vertically extending an internally hollow cavity which is threaded so that the sleeve 170 may be rotatably and threadably engaged around a threaded shaft portion 172. The shaft portion 172 is mounted in a vertically extending fashion from top to bottom within oven 12 and beyond the second side 20 of the enclosure by a fixed mount 174 proximate the oven bottom 16 and is further operably engaged at a corresponding upper end by a drive pulley 176 which is mounted at one end to the rotatably secured shaft 172 and at the other end to a modification 38' of the electric motor having a rotating gear drive head (not shown) for rotating the drive pulley 176 and, consequently, the shaft 172 in either of two selected rotational directions to actuate the covering member both upwardly and downwardly. Also, the pulley 176 may be replaced by a gear (not shown) for operating the shaft 172.

The shaft 172 is also fixedly and rotatably secured at its upper end although not clearly illustrated and, upon being actively rotated by an appropriate microprocessor command to the motor 38', causes the sleeve 170 to vertically translate along the shaft 172 between upper and lower positions within the oven interior. The vertically extending member 166, which is pivotally associated with the sleeve 170 at upper connection 168, is maintained in engagement with the abutting edges of the side 20 and ensures the conversion of rotational to translation motion between the shaft 172 and the projecting arm 156.

It is also understood that the threaded shaft can be substituted by a smooth shaft or like elongate support member which may exhibit any shape in cross section and which further provides a vertically disposed pulley arrangement (not shown) for upwardly and downwardly translating the cover.

The pivot switch assembly 164 includes an electrically communicable switch 178 which is secured to the sleeve 170 and includes an elongate body portion which is in communication with an electrically conducting inner sleeve portion 180 mounted within the sleeve 170 and concentrically located between the sleeve 170 and the shaft 172. The elongate switch 178 extends downwardly and outwardly where it terminates in a curved end contact 182. The end contact 182 is normally in electrical communication with an associated contact 184 located on an opposing inner face of the pivotally associated first vertically extending member 166 when the suspending weight of the covering member 150 is applied in cantilever fashion through the laterally projecting arm 156 and pivotally in a first direction against the first vertically extending member 166 so as to bias the inner facing contact 184 against the associated curved end contact 182. As was described in reference to the control schematic of FIG. 6, the switch assembly 164 may easily replace the spring-loaded spool assembly 58 and an appropriate communication line such as line 122 may be used to route the closed/open circuit signal to the microprocessor 70.

Figure 10:
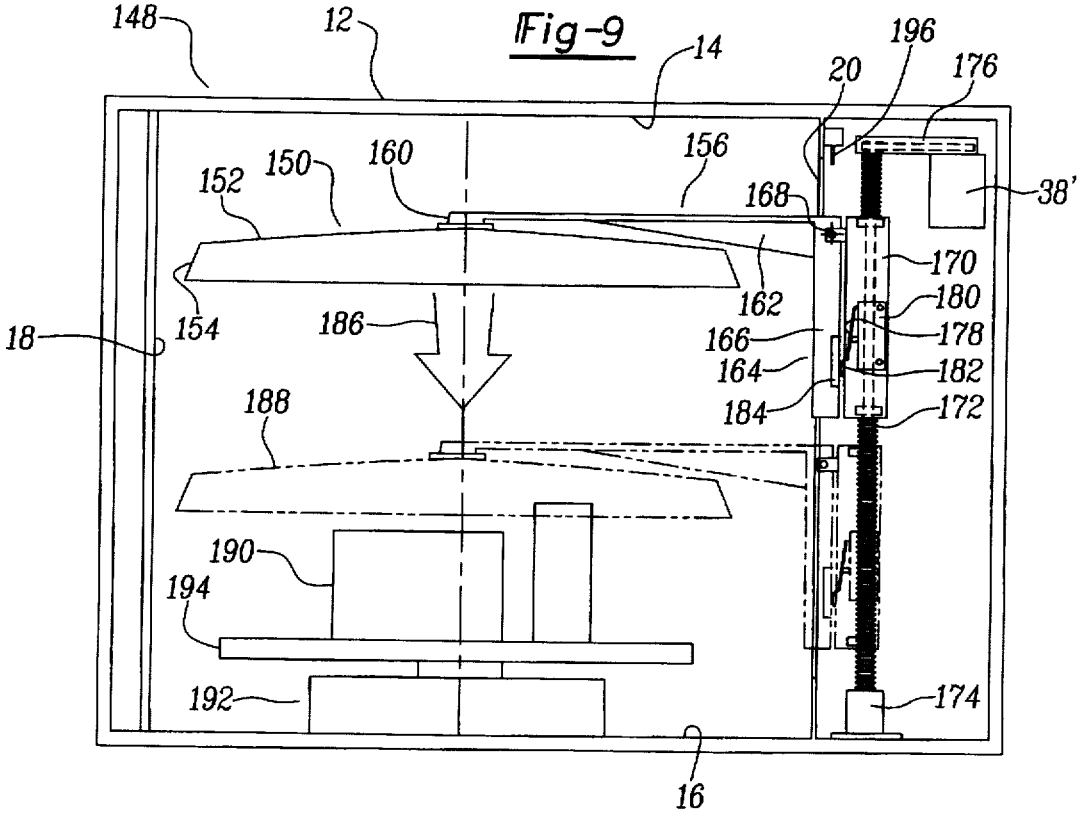
FIG. 10 is a frontal cutaway view taken along line 10—10 of FIG. 9 and illustrating the laterally projecting arm for supporting the covering member in both a first elevated position and second a lowered position shown in phantom along with the vertically extending and rotatable shaft for actuating the projecting arm and covering member.

As is best illustrated by viewing the illustration of FIG. 10, the electric motor 38' is actuated by the microprocessor 70 to downwardly actuate the covering member 150 in a fashion as was previously described from a first upper position illustrated in solid and downwardly along directional arrow 186 to a second lower position illustrated in phantom at 188 where it is positioned just short of contacting one or more food items 190 which are supported upon the microwave bottom 16, such as upon a rotating pedestal 192 supporting a planar food support surface 194.

Figure 11:
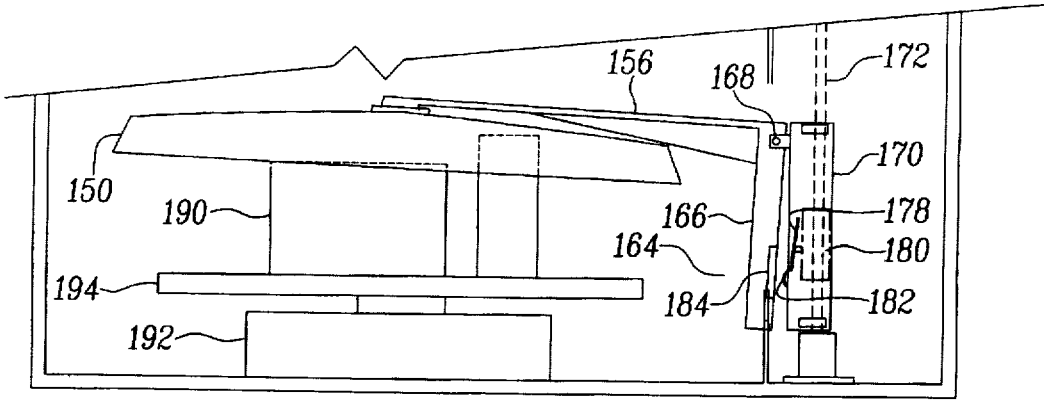
FIG. 11 is a frontal view similar to that illustrated in FIG. 10 and further showing the pressure actuated lever and switch assembly of the further preferred embodiment in an actuated and open circuit position.

Between the upper and lower positions illustrated in FIG. 10, the weight of the covering member 150 through the switch assembly 164 remains constant and the contacts 182 and 184 between the sleeve 170 and pivotally associated vertical member 166 remain in contact. Referring now to FIG. 11, further downward actuation of the covering member 150 is illustrated which causes the associated inner surfaces of the covering member 150 to abutting contact the associated top surfaces of the food items 190. Upon such contact being established, the cantilever weight of the covering member 150 is transferred to the food item(s) 190 and the covering member 150 and laterally projecting arm 156 will respond by rotating upwardly about the pivotal connection 168 established between the vertically extending member 166 and the threadably rotatably mounted sleeve 170. The upward rotation of the covering member 150 and arm 156 also causes the vertically extending member 166 to pivot outwardly from the bottom so that the switch contact 184 unseats from the associated switch contact 182 and thereby opens the previously closed circuit established through the inner sleeve portion 180.

Upon the establishment of an open circuit in the switching assembly 164, the microprocessor 70 is notified that the covering member 150 is in abutting contact with the food item (as again illustrated by an exemplary control schematic in FIG. 6) and in turn signals the electric motor 38' to shut off. It is also contemplated that the program memory 72 can be further programmed to issue a reset command to retract the covering member 150 upwardly a small distance so as not to contact the food and to allow to continue or permit the microwaving process to begin. A downwardly facing switch 196 may also be positioned within the oven interior in similar fashion to the switch 128 illustrated pictorially in FIG. 1 and schematically in FIG. 6. The switch 196 operates identically to the switch 128 of the first preferred embodiment for instructing the microprocessor 70 to shut off the electric motor 38' once the covering member 150 has been sufficiently elevated which occurs upon termination of the heating cycle, opening the microwave door or in any other fashion as described in detail in the first preferred embodiment.

The embodiment 148 envisions the ability to utilize the cantilever mounting of the covering member 150 via the laterally extending arm 156 to operate the pivotal switching assembly 164 as a distinct and separate embodiment of the present invention. Referring again to FIG. 9, and also to FIGS. 12 and 13, an additional feature of the embodiment 148, or potential separate and further preferred variant of the present invention, discloses the use of lighted beams, such beams or infrared X-ray beams, for providing a light sensor assembly for both determining a height and arrangement of a food item set upon the base of the microwave interior, as well as a corresponding and necessary distance for downwardly actuating the covering member so as to position it directly overhead the food item(s).

Figure 9:
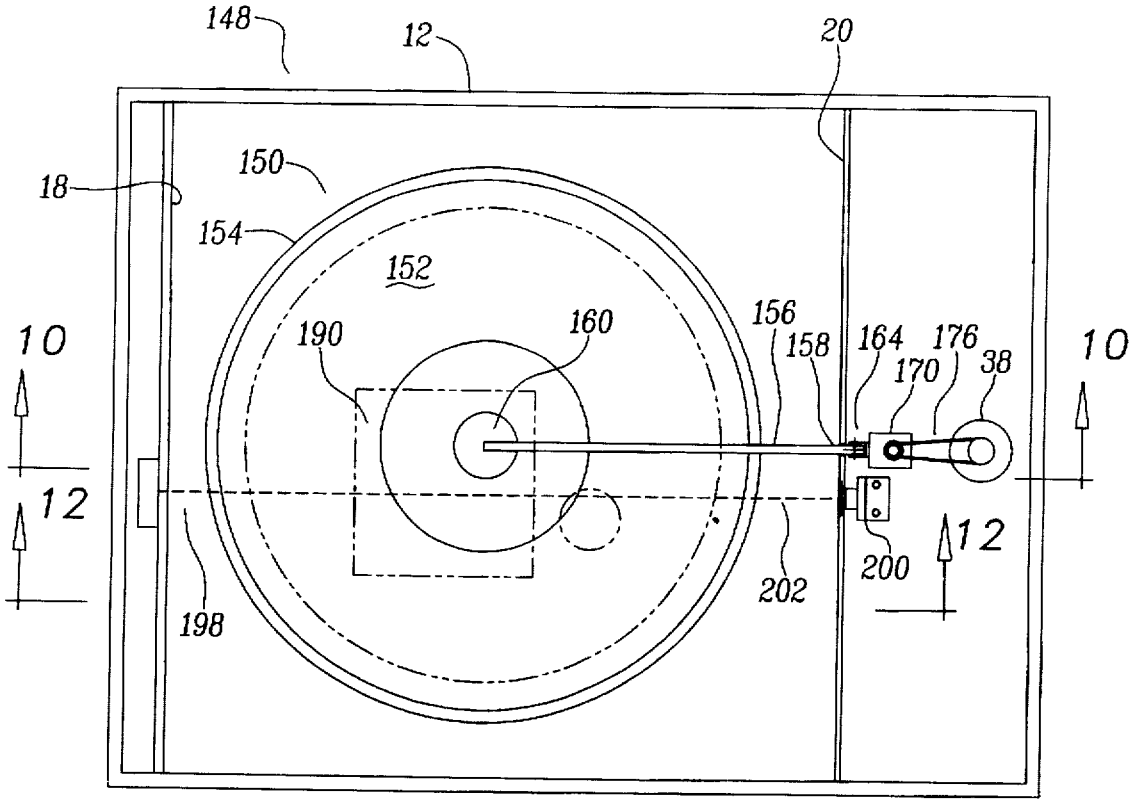
FIG. 9 is a top view of the microwave oven with built-in food covering mechanism according to a further preferred embodiment of the present invention.

Referring to the overhead view of FIG. 9, a first plurality of light emitting diodes 198 are arranged along the first side 18 of the oven interior and a second like plurality of photo transistors 200 are arranged in corresponding and opposing fashion along the second side 20 of the oven interior. A plurality of beams, illustrated in the overhead view of FIG. 9 at 202, extend across the oven interior in horizontal fashion between the diodes 198 and photo transistors 200. As will be better explained, the beams can be selected from a broad spectrum of differing wavelengths including light rays, infrared rays and X-rays and microwave impulse rays and the method of generating and issuing such rays is known in the art.

Figure 12:
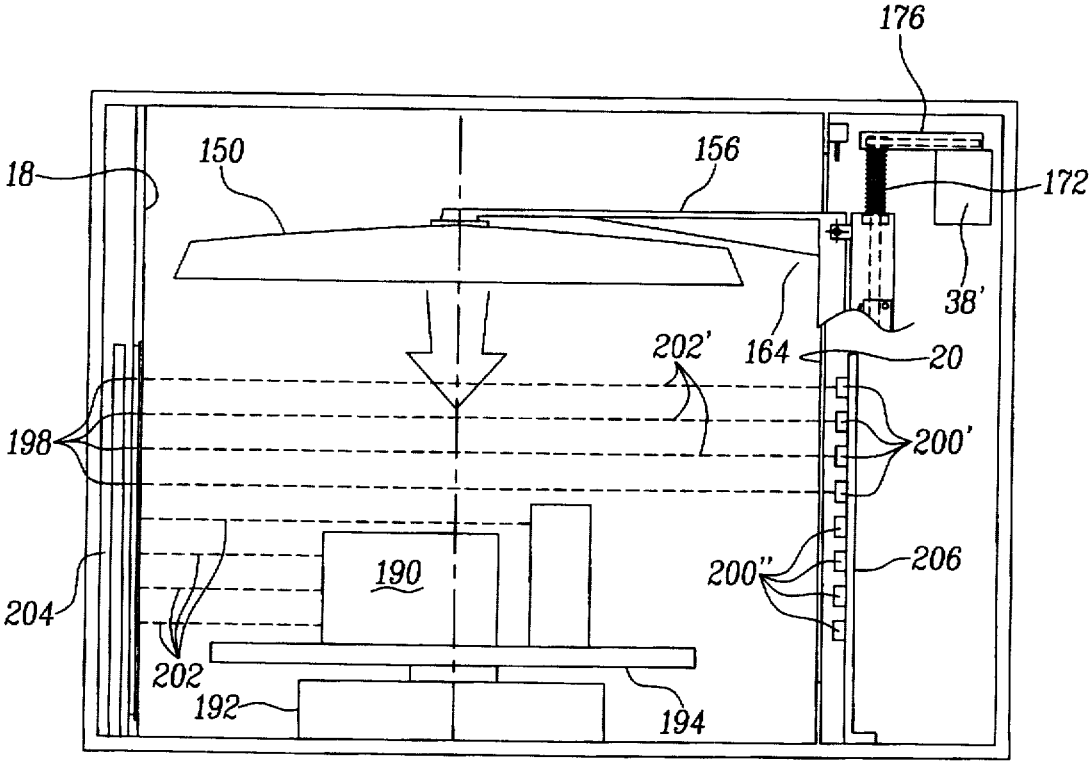
FIG. 12 is a frontal cutaway view taken along line 12—12 of FIG. 9 and illustrated the pairs of vertically spaced apart and horizontally arrayed photo diodes and photo transistors according to a variant of the further preferred embodiment of the present invention.

As is better shown in the frontal view of FIG. 12, the plurality of diodes 198 are illustrated in vertically spaced apart fashion extending along the first side 18 of the oven interior and according to desired spaced apart intervals. The like plurality of photo transistors 200 are likewise shown extending at similarly spaced apart distances and in vertical fashion along the second side 20 so that the beams 202 extending horizontally and in orderly spaced apart fashion across the microwave interior. Although not clearly illustrated in FIG. 12, the light emitting diodes 198 are secured within the wall defining the side 18 and each diode issues a light or infrared ray beam which is preferably 30 degrees wide in a horizontal plane towards the opposite side of the oven. A clear window material (not shown) covers the openings for both the diodes and photo transistors and prevents food and other debris from entering the holes or otherwise obscuring the openings. A first communication line 204 extends vertically within the first associated side 18 of the oven for supplying the light or infrared input to the diodes 198 and an associated communication line 206 likewise extends in like fashion along the second associated side in communication with the photo transistors 200 for the purpose which will now be described.

Referring again to FIG. 12, and also to the schematic illustration of FIG. 13, an explanation of the operation of the diode and photo transistor variant of the present invention will now be made. Referring specifically to FIG. 13, the first plurality of diodes 198 are illustrated schematically at vertical spaced intervals and interconnected by the communication line 204. The communication is connected to ground at end 208 and to a current limiting resistor at 210. When activated, the diodes 198 each issue a beam of light or infrared ray as dictated by the source of supply which extends in horizontal fashion across the interior 22 of the oven.

Referring again to FIG. 12, a first upper plurality of the beams 202' so created will extend across the entire interior of the oven and will be received, or sensed, by the associatingly mounted photo transistor. A second lower plurality of the beams 202" will be interrupted by the food item(s) 190 which are placed within the microwave interior and will not be sensed by the associated lower photo transistors 200 located on the opposite oven side 20.

Referring again to FIG. 13, a portion of the communication line 206 identified in FIG. 12 includes a line 212 which inputs to each of the photo transistors 200 in parallel fashion and which is connected to ground at 214. A series of pull up resistors 216, 218, 220 and 22 are located and are separately communicated with each of the plurality of photo transistors 200, such as by a first line 224 communicating a pull up resistor 216 with a first selected photo transistor, a second line 226 communicating a pull up resistor 218 with a second selected photo transistor, a third line 228 communicating a pull up resistor 220 with a third selected photo transistor and a fourth line 230 communicating a pull up resistor 222 with a fourth selected photo transistor. The communication between each of the pull up resistors and its associated photo transistors is provided by a further communication line, such as lines 232, 234, 236 and 238 as illustrated, and each of these lines 232, 234, 236 and 238 extend from between an input/output of the associated photo transistor to an input port of the microprocessor 70. The photo transistors 200 are also connected to a voltage supply (not shown) through the pull up resistors.

In use, a first plurality of the photo transistors, such as are identified at 200' in FIG. 12, will sense the light beam or infrared ray issued by its corresponding diode 198 and will be activated to an "ON" state. When in the "ON" state, the resistance of the photo transistor is calibrated so that it is pulled to ground and zero ohms are read and thus no voltage is created across the transistor. A zero voltage applied across a selected input port to the microprocessor indicates there is no obstruction to that selected photo transistor.

Upon placing the food item within the oven interior, one or more of the lower positioned photo transistors 200" (FIG. 12) will be turned to an "OFF" stage due to the food item obstructing the beam or path of light. Upon a selected photo transistor being turned to "OFF", the resistance of the transistor becomes virtually infinite and its associated pull up resistor causes it to be pulled up to the supply voltage, such as a conventional DC supply voltage.

The microprocessor 70 is thus capable of easily determining which photo transistors are in the "ON" position (200') and which are in the "OFF" position (200") to effectively determine the height of the food item 190. The simplified schematic of FIG. 13 illustrates four diodes 198 and associated photo transistors 200 and the illustration of FIG. 12 shows eight apiece of these elements. It is understood however that a greater number of diode and photo transistor pairs may be employed to more accurately gauge a height of a food item and the corresponding positioning of the covering member which is desired. Specifically, four, eight, twelve, sixteen or thirty-two such sensors may be employed and the microprocessor will possess an equivalent number of input ports to identify the status of each photo transistor of each sensor. It is easily understood that the use of a greater number of sensors will result in a greater degree of correction factor for positioning the covering member overhead the food item.

Figure 6:
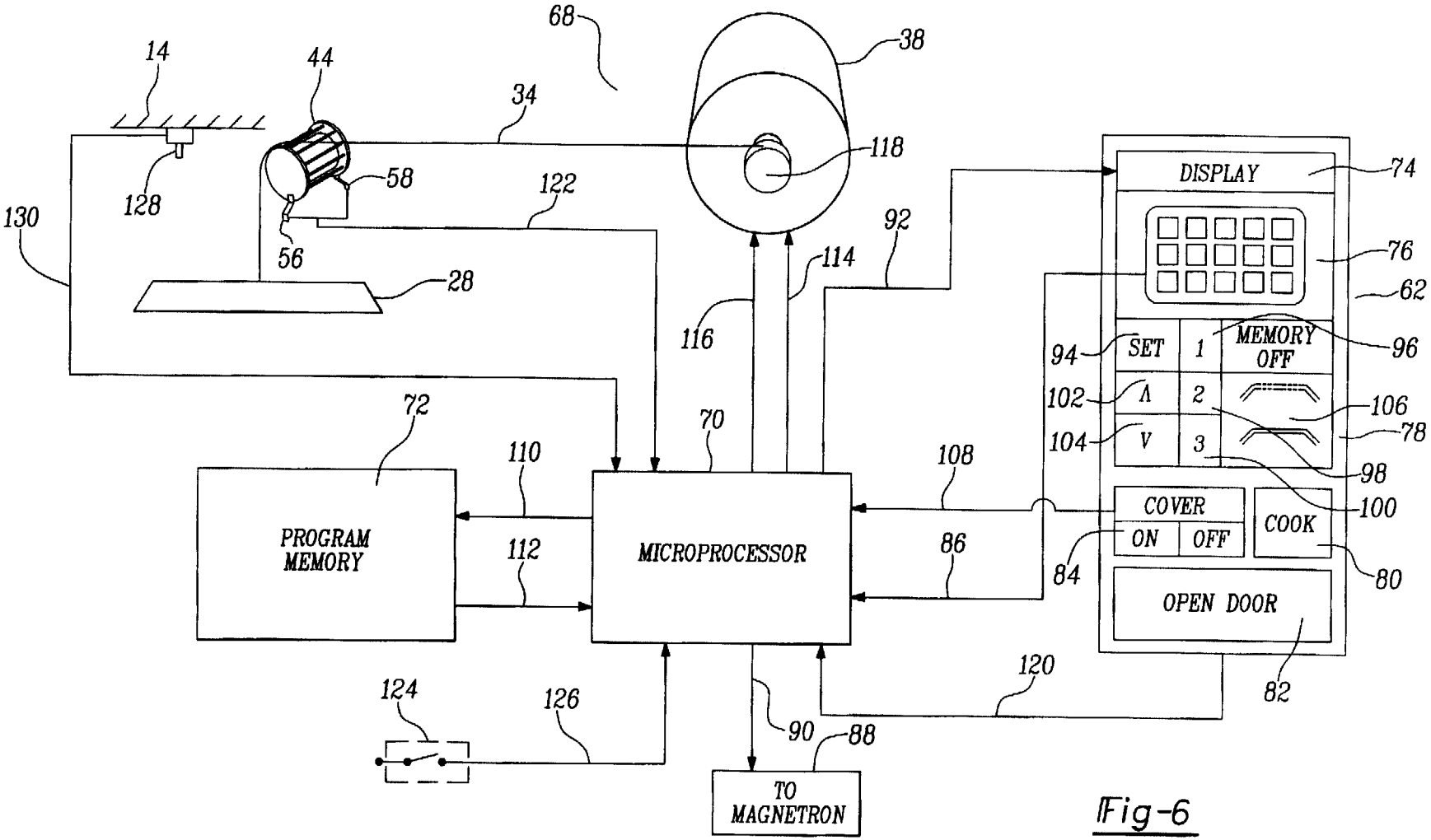
FIG. 6 is a control diagram showing the arrangement of elements comprising the cover member actuation means according to the present invention.

Referring again to the example of the control schematic shown in FIG. 6, it is understood that the sensor arrangement herein described can be substituted for either the sensing spool assembly 58 shown or the switch assembly 164 alternately described for controlling the extent of downward actuation of the covering member. This is accomplished by the microprocessor interpreting the ON/OFF states of the various photo transistors and issuing the appropriate command signal along line 116 to the electric motor to lower the covering member to a height approximately equal to the lowest sensed photo transistor on the "ON" position. As with each of the preferred embodiments, the program memory 72 may contain a correction factor, such at ¼" to ½" in a reverse upward direction which the microprocessor can signal the motor on through line 114 to elevate the covering member a sufficient distance so that it is not in contact with the food item. The provision of the beams allows the food item, upon being rotated a complete revolution, a first plurality of lower beams, the downwardly descending cover then breaking the remaining unobstructed upper beams. Additionally, a still further correction factor can be incorporated into the program memory which is accessible by the microprocessor to lower the cover a still further predetermined distance, such as 1" to 1½" to allow the side of cover to adequately encircle the food and to protect the oven from spatter.

Referring finally to FIG. 14, a still further preferred variant 240 is illustrated of the actuating cover mechanism according to the present invention for elevating and lowering the covering member 150. The view of FIG. 14 is largely similar to that shown in FIG. 12, with the exception of a radar emitter/receptor device 242 which is mounted in a generally centralized location along the top 14 of the oven interior. The emitter/receptor device 242 includes a semispherically shaped lower portion 244 from which are issued a plurality of radiation X-rays or other similar type rays in a pulse fashion. As with the diode and photo transistor variant, the type of rays which are generated can be drawn from either the lighted spectrum or from infrared and X-ray wavelengths as may be provided in the art and the mechanism for generating the pulse rays is likewise known.

As has been further recently developed in the art, microwave impulse radar (MIR) technology is now available which can provide a circuit board device measuring no more than a few inches in dimension and which is capable of sending and receiving a great number of ultra-short radio pulses for assembling a radar image of a food item placed within the microwave. MIR technology is capable of emitting a million or so individual pulses a second which are unevenly spaced and varied as a function of time so as to make it easier for the radar to recognize its own echo and to facilitate travel through a suspended covering member.

A plurality of individual beams or pulses 246 are illustrated being issued from the semispherical portion 244 in an outwardly spread fashion. The actual number of beams 246 is greatly in excess of what is shown, however it is understood that the beams 246 thoroughly extend through the microwave interior. It is also understood that the beams 246 are calibrated so that they may pass through the covering member 150 without distorting the image of the food item. The covering member may therefore be constructed in any manner desired without compromising the ability of the beams 246 to pass through in a substantially undiffracted manner.

While not clearly illustrated in FIG. 14, it is understood that the X-ray, infrared or radio beams or pulses are reflected back to the semispherical portion 244 in a manner similar to conventionally known radar and sonar devices and permit the emitter/receptor device 242 to assemble data which is representative of an image of the food item 190. An additional element, not shown, assembles the three dimensional image of the food item and communicates with the microprocessor which is then appropriately instructs the gear motor to adjustably position the covering member.

The assembly shown in FIG. 14 otherwise operates substantially as shown in the other embodiments and can be used both with and without the switch assembly 164 shown in FIGS. 10–12 for controlling the downward actuation of the covering member. A reverse limiting switch 196 is again employed to instruct the microprocessor when the cover has been completely elevated subsequent to the microwaving operation or when the microwave door has been opened, tripping the door switch.

Having described my invention, additional embodiments will become apparent to those skilled in the art to which it pertains. Other variations of electrical schematics may also be provided for elevating and lowering the cover member, the above disclosed being only the preferred embodiments.

I claim:

1. A microwave oven with a built-in food covering mechanism, the microwave oven having a body with an open interior defined by a top, a bottom and at least one side, a door hingedly attaching to the body and being selectively opened and closed to reveal the open interior, said food covering mechanism comprising:

a covering member having a body portion and a downwardly extending side portion extending around a circumference of said body portion;

suspending means attaching to said covering member and suspending said covering member within the microwave oven interior;

actuation means for elevating and for lowering said covering member to and from desired positions between the top and the bottom of the microwave oven interior, said actuation means including:

an electric motor operably connected to said covering member through said suspending means;

said suspending means further comprising a length of cord, a first end of said cord attaching to said electric motor, an intermediate portion of said cord being engaged by a support positioned in the microwave oven top for slidably receiving said cord, and a second end of said cord attaching to said suspended covering member, said support further comprising a sensing spool assembly with an exteriorly facing and cylindrically shaped winding surface and a plurality of spring loaded wires which extend in parallel spaced apart and circumferential fashion relative to and around said cylindrically exterior facing surface;

microprocessor means communicating with said electric motor and operable to selectively activate and deactivate said motor; and said covering member being actuable to a first lowered position wherein said body portion and downwardly extending side portion covers an item placed upon the bottom of the microwave oven interior prior to and during heating, said covering member being subsequently actuable to a second elevated and retracted position proximate to the top of the microwave oven interior subsequent to said heating to permit entry and removal of the item.

2. The microwave oven with built-in food covering mechanism according to claim 1, said cylindrically shaped exterior facing surface and said spring loaded wires both being electrically communicable, at least one of said wires being inwardly deflected against said exterior surface by virtue of the suspended weight of said covering member transferred through said cord in a first position to form a closed circuit with said microprocessor means, said at least one wire outwardly deflecting away from said exterior surface in a second position due to a slackening in said cord which is representative of said covering member contacting a food item to form an open circuit with said microprocessor means, said microprocessor means instructing a deactivation of said covering member upon receipt of a signal indicating the existence of an open circuit.

3. A microwave oven with a built-in food covering mechanism, the microwave oven having a body with an open interior defined by a top, a bottom and at least one side, a door hingedly attaching to the body and being selectively opened and closed to reveal the open interior, said food covering mechanism comprising:

a covering member having a body portion and a downwardly extending side portion extending around a circumference of said body portion;

suspending means attaching to said covering member and suspending said covering member within the microwave oven interior;

actuation means for elevating and for lowering said covering member to and from desired positions between the top and the bottom of the microwave oven interior, said actuation means including:

an electric motor operably connected to said covering member through said suspending means, said electric motor further comprising an AC/DC electric motor with a rotating gear head;

said suspending means further comprising a length of cord, a first end of said cord attaching to said electric motor, an intermediate portion of said cord being engaged by a support positioned in the microwave oven top for slidably receiving said cord, and a second end of said cord attaching to said suspended covering member, said gear head of said motor selectively winding and unwinding said cord to elevate and lower said covering member;

microprocessor means communicating with said electric motor and operable to selectively activate and deactivate said motor; and said covering member being actuable to a first lowered position wherein said body portion and downwardly extending side portion covers an item placed upon the bottom of the microwave oven interior prior to and during heating, said covering member being subsequently actuable to a second elevated and retracted position proximate to the top of the microwave oven interior subsequent to said heating to permit entry and removal of the item.

4. A microwave oven with a built-in food covering mechanism, the microwave oven having a body with an open interior defined by a top, a bottom and at least one side, a door hingedly attaching to the body and being selectively opened and closed to reveal the open interior, said food covering mechanism comprising:

a covering member having a body portion and a downwardly extending side portion extending around a circumference of said body portion;

suspending means attaching to said covering member and suspending said covering member within the microwave oven interior;

actuation means for elevating and for lowering said covering member to and from desired positions between the top and the bottom of the microwave oven interior, said actuation means including:

an electric motor operably connected to said covering member through said suspending means;

microprocessor means communicating with said electric motor and operable to selectively activate and deactivate said motor, a door switch operably connected to the door and instructing said microprocessor means to raise said covering member upon the door being opened, a start button instructing said microprocessor means to lower said covering member; and said covering member being actuable to a first lowered position wherein said body portion and downwardly extending side portion covers an item placed upon the bottom of the microwave oven interior prior to and during heating, said covering member being subsequently actuable to a second elevated and retracted position proximate to the top of the microwave oven interior subsequent to said heating to permit entry and removal of the item.

5. A microwave oven with a built-in food covering mechanism, the microwave oven having a body with an open interior defined by a top, a bottom and at least one side, a door hingedly attaching to the body and being selectively opened and closed to reveal the open interior, said food covering mechanism comprising:

a covering member having a body portion and a downwardly extending side portion extending around a circumference of said body portion;

suspending means attaching to said covering member and suspending said covering member within the microwave oven interior, said suspending means further comprising a laterally projecting arm which extends substantially horizontally within the microwave oven interior and secures at a first end to said covering member;

actuation means for elevating and for lowering said covering member to and from desired positions between the top and the bottom of the microwave oven interior, said laterally projecting arm extending through a vertically extending channel formed in the at least one side of the microwave oven interior and being secured to said actuation means, said actuation means including:

an electric motor operably connected to said covering member through said suspending means;

microprocessor means communicating with said electric motor and operable to selectively activate and deactivate said motor; and said covering member being actuable to a first lowered position wherein said body portion and downwardly extending side portion covers an item placed upon the bottom of the microwave oven interior prior to and during heating, said covering member being subsequently actuable to a second elevated and retracted position proximate to the top of the microwave oven interior subsequent to said heating to permit entry and removal of the item.

6. The microwave oven with built-in food covering mechanism according to claim 5, said actuation means further comprising a vertically extending member to which said laterally projecting arm is secured, said extending member being pivotally secured at an upper end thereof to a sleeve which is threadably and rotatably secured around a vertically extending and threaded shaft, said shaft being in operable communication with said electric motor through a pulley and, responsive to commands from said microprocessor means, to rotate in first and second rotational directions to upwardly and downwardly actuate said covering member within the microwave oven interior.

7. The microwave oven with built-in food covering mechanism according to claim 6, further comprising a switch secured to said sleeve and terminating in a first contact, an opposing and inward face of said pivotally secured vertical extending member having a second and associated contact which abuts against said first contact in a first position when said covering member is suspended to form a closed circuit with said microprocessor means, said covering member abutting a food item in a second position to cause said laterally projecting arm and said associated vertical member to pivot upwardly, thereby causing said second switch contact to unseat from said first switch contact and to form an open circuit with said microprocessor means, said microprocessor means instructing a deactivation of said covering member upon the receipt of a signal indicating the existence of an open circuit.

8. A microwave oven with a built-in food covering mechanism, the microwave oven having a body with an open interior defined by a top, a bottom and at least one side, a door hingedly attaching to the body and being selectively opened and closed to reveal the open interior, said food covering mechanism comprising:

a covering member having a body portion and a downwardly extending side portion extending around a circumference of said body portion;

suspending means attaching to said covering member and suspending said covering member within the microwave oven interior;

actuation means for elevating and for lowering said covering member to and from desired positions between the top and the bottom of the microwave oven interior, said actuation means including:

a first plurality of emitting diodes arranged at vertically spaced apart intervals along a first selected side of the microwave oven interior, a second like plurality of photo transistors being arranged in similar and vertically spaced apart intervals along a second selected side of the microwave oven interior, sensor means operating between said first plurality of diodes and said second plurality of photo transistors to establish an overall height of a food item;

an electric motor operably connected to said covering member through said suspending means;

microprocessor means communicating with said electric motor and operable to selectively activate and deactivate said motor; and said covering member being actuable to a first lowered position wherein said body portion and downwardly extending side portion covers the item placed upon the bottom of the microwave oven interior prior to and during heating, said covering member being subsequently actuable to a second elevated and retracted position proximate to the top of the microwave oven interior subsequent to said heating to permit entry and removal of the item.

9. The microwave oven with built-in food covering mechanism according to claim 8, said sensor means further comprising each of said diodes emitting a continuous wavelength beam across the oven interior, a first sub-plurality of said beams being received by first selected photo transistors, a second sub-plurality of said beams being interrupted by a food item placed within the oven interior and not be received by second selected photo transistors, said first and second selected photo transistors each outputting an appropriate signal to said microprocessor means which establishes an overall height of the food item and subsequently activates said electric motor to actuate said covering member to a desire position.

10. The microwave oven with built-in food covering mechanism according to claim 9, further comprising a voltage source being applied to said photo transistors, a series of pull up resistors being separately communicated with each of said photo transistors and capable of determining the existence or absence of a resistance through said associated photo transistor which is in turn indicative of the presence or absence of a beam from said associated diode, said microprocessor means including a plurality of individual input ports which are associated with each of said photo transistors.

11. A microwave oven with a built-in food covering mechanism, the microwave oven having a body with an open interior defined by a top, a bottom and at least one side, a door hingedly attaching to the body and being selectively opened and closed to reveal the open interior, said food covering mechanism comprising:

a covering member having a body portion and a downwardly extending side portion extending around a circumference of said body portion;

suspending means attaching to said covering member and suspending said covering member within the microwave oven interior;

actuation means for elevating and for lowering said covering member to and from desired positions between the top and the bottom of the microwave oven interior, said actuation means including:

an emitter/receptor unit mounted in a generally centralized location to the top of the oven enclosure, said emitter/receptor unit including a downwardly facing portion which issues a plurality of discrete pulses of a desired wavelength beam which are distributed throughout the oven interior and are recollected by said emitter/receptor unit to subsequently calculate an overall height of a food item;

an electric motor operably connected to said covering member through said suspending means;

microprocessor means communicating with said electric motor and operable to selectively activate and deactivate said motor; and said covering member being actuable to a first lowered position wherein said body portion and downwardly extending side portion covers the item placed upon the bottom of the microwave oven interior prior to and during heating, said covering member being subsequently actuable to a second elevated and retracted position proximate to the top of the microwave oven interior subsequent to said heating to permit entry and removal of the item.

* * * * *

UNITED STATES PATENT AND TRADEMARK OFFICE

CERTIFICATE OF CORRECTION

PATENT NO. : 5,801,363

DATED : September 1, 1998

INVENTOR(S) : Mitchell Michaluk III

It is certified that error appears in the above-identified patent and that said Letters Patent is hereby corrected as shown below:

Column 2, line 13, Insert -- and -- after the word "body".
Column 4, line 27, Delete "second a" and insert -- a second --.
Column 4, line 66, Replace "open" with -- oven --.
Column 6, line 3, Replace "combing" with -- coming --.
Column 6, line 28, Replace "56" with -- 66 --.
Column 6, line 29, Replace "Fig. 2" with -- Fig. 6 --.
Column 6, line 53, Replace "Fig. 2." with -- Fig. 6 --.
Column 7, line 6, Replace "Fig. 2" with -- Fig. 6 --.
Column 8, line 17, Replace "Fig. 2" with --Fig. 6--.
Column 8, line 30, Replace "Fig. 2" with --Fig. 6--.
Column 8, line 30, Replace "102" with --116--.
Column 9, line 5, Replace "Fig. 3" with --Fig. 7--.
Column 9, line 16, Replace "Fig. 3" with --Fig. 7--.
Column 9, line 18, Replace "Fig. 4" with --Fig. 8--.
Column 12, line 46, Replace "22" with --222--.

Signed and Sealed this

Tenth Day of August, 1999

*Attest:*

Q. TODD DICKINSON

*Attesting Officer*

*Acting Commissioner of Patents and Trademarks*